US012279708B2

(12) United States Patent
Westhoven et al.

(10) Patent No.: US 12,279,708 B2
(45) Date of Patent: Apr. 22, 2025

(54) MULTI-FUNCTIONAL COVER FOR TRAY TABLES

(71) Applicant: Forum Brands, LLC, New York, NY (US)

(72) Inventors: Nicholas Westhoven, New York, NY (US); Carolyn Vanous, Shoreview, MN (US)

(73) Assignee: Forum Brands, LLC, New York, NY (US)

( * ) Notice: Subject to any disclaimer, the term of this patent is extended or adjusted under 35 U.S.C. 154(b) by 0 days.

(21) Appl. No.: 18/887,321

(22) Filed: Sep. 17, 2024

(65) Prior Publication Data

US 2025/0009151 A1 Jan. 9, 2025

Related U.S. Application Data

(63) Continuation-in-part of application No. 18/430,561, filed on Feb. 1, 2024, which is a continuation of application No. 18/481,412, filed on Oct. 5, 2023, now Pat. No. 11,925,282.

(51) Int. Cl.
*A47G 11/00* (2006.01)
*A45F 5/00* (2006.01)

(52) U.S. Cl.
CPC ..... *A47G 11/004* (2013.01); *A45F 5/00* (2013.01); *A45F 2005/002* (2013.01); *A45F 5/1525* (2025.01)

(58) Field of Classification Search
CPC ... A47G 11/004; A45F 5/00; A45F 2005/002; A45F 2200/0525
See application file for complete search history.

(56) References Cited

U.S. PATENT DOCUMENTS 2,637,136 A * 5/1953 Mark ..... A63F 1/06 108/90
3,310,091 A * 3/1967 Geisen ..... A47G 11/004 108/90
4,500,129 A * 2/1985 Hahn ..... A01G 9/04 383/4

(Continued)

FOREIGN PATENT DOCUMENTS

BR MU8902277 U2 * 6/2011
EP 3289927 A1 * 3/2018

(Continued)

*Primary Examiner* — Hanh V Tran
(74) *Attorney, Agent, or Firm* — Tatonetti IP

(57) ABSTRACT

A multi-functional tray table cover is configured with a flexible sleeve and a relatively more rigid use area that enables users to simultaneously hygienically protect themselves from the tray table while still having an area for functional and practical purposes. For example, the flexible sleeve, which may be comprised of a spandex material, can stretch or at least encapsulate a tray table. Once positioned over the tray table, the rear side of the sleeve is exposed while the tray table is in a down position. When the user props up the tray table, the use portion of the tray table cover is exposed. The use portion includes a series of receptacles, such as pockets, pouches, and the like, that the user can input various items, such as water or other bottles, pens, pencils and other writing utensils, and other personal or professional items.

18 Claims, 8 Drawing Sheets

(56) References Cited

U.S. PATENT DOCUMENTS 4,574,990 A * 3/1986 Remis ..... A45C 3/00 224/155
4,777,992 A * 10/1988 Olger ..... A47G 11/003 206/541
5,695,240 A * 12/1997 Luria ..... B64D 11/0636 297/163
5,878,672 A * 3/1999 Ostermann ..... B60N 3/004 297/188.06
5,979,337 A * 11/1999 Clark ..... A47B 23/002 248/444
6,240,667 B1 * 6/2001 Harney ..... G09F 21/049 108/90
6,986,308 B1 * 1/2006 King ..... A47G 23/0608 108/43
7,104,201 B2 * 9/2006 Comeaux ..... A61B 50/13 108/90
7,699,197 B2 * 4/2010 Panosian ..... A45F 5/02 224/665
7,971,929 B2 * 7/2011 Kennard ..... B64D 11/0638 297/146
7,976,099 B2 * 7/2011 Ferrara ..... B60N 3/002 297/135
8,635,959 B1 * 1/2014 Silknitter ..... A47G 23/0608 108/43
9,295,603 B1 * 3/2016 Selnow ..... A47G 11/004
9,403,464 B2 * 8/2016 Valcic ..... B60R 7/043
9,549,606 B1 * 1/2017 Casadesus ..... F41H 1/00
2001/0039903 A1 * 11/2001 Patterson ..... B60N 3/004 108/44
2006/0169731 A1 * 8/2006 Matulewic ..... A63B 57/00 224/684
2009/0223418 A1 * 9/2009 Ferrara ..... B60N 3/004 108/14
2010/0015882 A1 * 1/2010 Givens ..... A63H 33/006 446/227
2010/0294821 A1 * 11/2010 Szabo ..... B23K 5/22 224/661
2011/0013856 A1 * 1/2011 Gilbert ..... A63H 33/006 383/4
2012/0308164 A1 * 12/2012 Hudson ..... H04M 1/04 383/98
2014/0377480 A1 * 12/2014 Davino ..... B64D 11/0638 428/12
2014/0377499 A1 * 12/2014 Davino ..... B64D 11/0638 428/99
2015/0111626 A1 * 4/2015 Bell ..... G06F 1/1637 455/575.8
2015/0175081 A1 * 6/2015 Rodriguez ..... A45C 7/0077 224/275
2016/0183392 A1 * 6/2016 Kelley ..... H04B 1/3877 211/26
2017/0071375 A1 * 3/2017 Smith ..... B64D 11/0638
2017/0291710 A1 * 10/2017 Barr-Perea ..... B61D 33/0007
2019/0159579 A1 * 5/2019 Picking ..... A45F 5/021
2021/0145193 A1 * 5/2021 Presley ..... B60N 3/004
2022/0079311 A1 * 3/2022 Logan ..... A45F 3/02

FOREIGN PATENT DOCUMENTS

WO WO-2011160032 A1 * 12/2011 ..... B60N 3/004
WO WO-2014052683 A1 * 4/2014 ..... A45C 11/00

* cited by examiner

MULTI-FUNCTIONAL COVER FOR TRAY TABLES

CROSS-REFERENCES TO RELATED APPLICATIONS

This Non-Provisional Patent Application is a Continuation-In-Part (CIP) Application that claims the benefit of and priority to U.S. patent application Ser. No. 18/430,561, filed Feb. 1, 2024, entitled "Multi-Functional Cover for Tray Tables," which claims the benefit of and priority to U.S. patent application Ser. No. 18/481,412, filed Oct. 5, 2023, entitled "Multi-Functional Cover for Tray Tables," the entire contents of both applications of which are hereby incorporated herein by reference.

BACKGROUND

Tray tables that provide people a place to put their food, drinks, paperwork, laptops, etc., are often plagued with hygienic, organizational, and tidiness challenges. These tray tables may be most apparently present in transportation locales, such as airplanes, airports, trains, and waiting areas, but other places may also have tray tables to provide people a place to station themselves. Many people, such as passengers, often touch these tray tables, which can harbor germs. Many travelers seek to protect themselves from exposure to such germs. Individuals with less-developed immune systems may be particularly vulnerable to sickness from tray table germs.

In addition, organizational and tidiness problems may occur for adults on long-distance travel. Adults may attempt to bring various items, such as writing tools, notepads, water bottles, headphones, etc., but these items may be difficult to keep organized and used with a tray table. Even more, adults may simply forget to bring such items without a dedicated tool.

SUMMARY

A multi-functional tray table cover is configured with a flexible sleeve and a relatively more rigid use area that enables users to simultaneously hygienically protect themselves from the tray table while still having an area for functional and practical purposes. For example, the flexible sleeve, which may be comprised of a spandex material, can stretch or at least encapsulate a tray table. Once positioned over the tray table, the rear side of the sleeve is exposed while the tray table is in a down position. When the user props up the tray table, the use portion of the tray table cover is exposed. The use portion includes a series of receptacles, such as pockets, pouches, and the like, that the user can input various items, such as water or other bottles, pens, pencils and other writing utensils, and other personal or professional items.

Notably, the tray table cover and its use and sleeve portions were specifically configured to leverage all available real estate under tray table constraints while also enhancing the user's ability to have sufficient, or at least 'best possible,' receptacles. Various configurations and adaptations were implemented for the tray table cover to achieve this end. This includes, for example, configuring the sleeve fabric and stretchability factor to achieve a unique effect, utilizing connecting mechanisms, like stitching, between specific components and among arrangements to ensure that the maximum possible real estate was leveraged while the user experience and effectiveness with the tool were maximized.

This Summary is provided to introduce a selection of concepts in a simplified form that is further described below in the Detailed Description. This Summary is not intended to identify key features or essential features of the claimed subject matter, nor is it intended to be used as an aid in determining the scope of the claimed subject matter. Furthermore, the claimed subject matter is not limited to implementations that solve any or all disadvantages noted in any part of this disclosure. These and various other features will be apparent from a reading of the following Detailed Description and a review of the associated drawings.

DESCRIPTION OF THE DRAWINGS

Like reference numerals indicate like elements in the drawings. Elements are not drawn to scale unless otherwise indicated.

DETAILED DESCRIPTION

Figure 1:
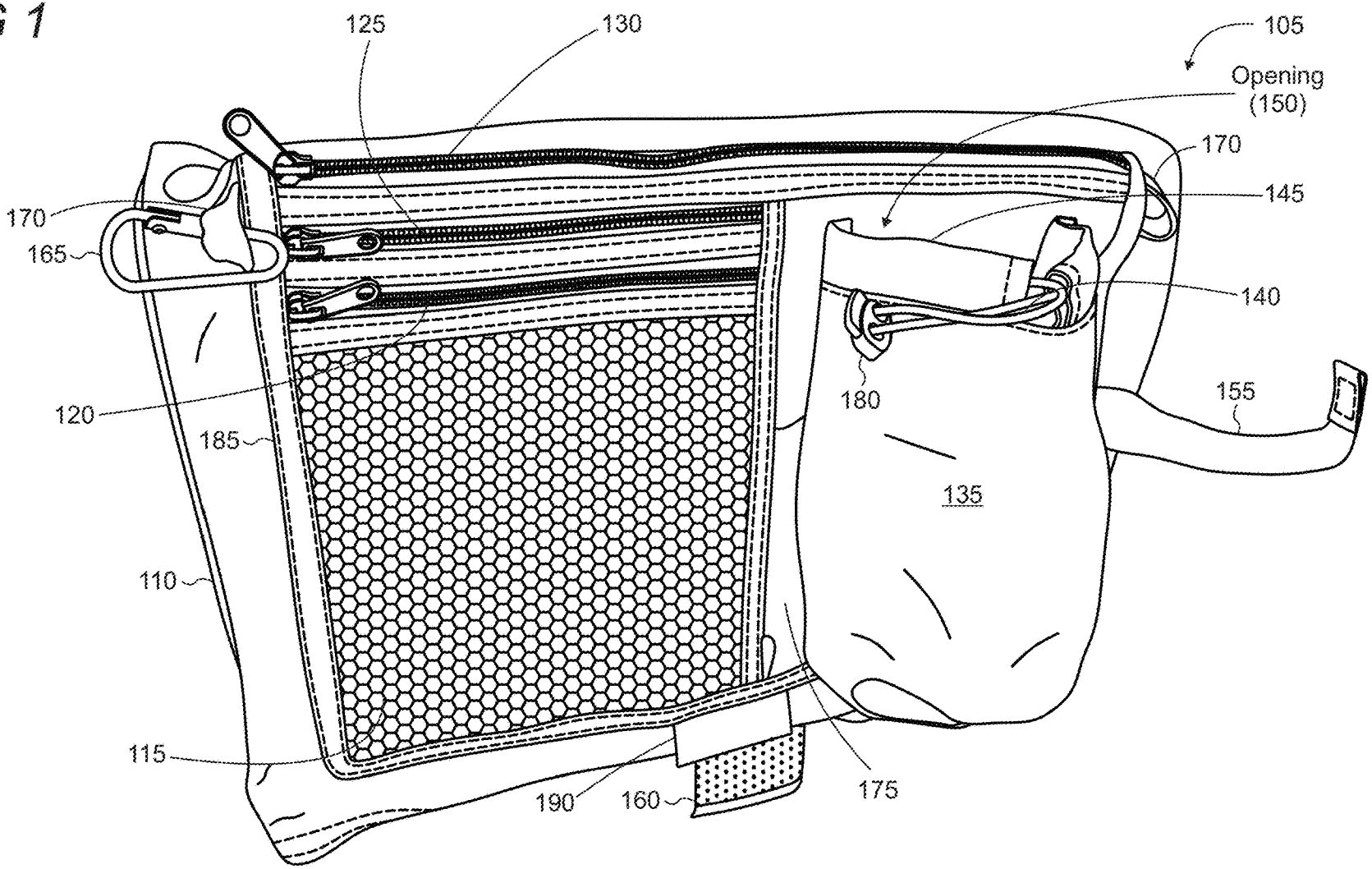
FIG. 1 shows an illustrative representation of the front side of the tray table cover.

FIG. 1 shows an illustrative representation in which a tray table cover 105 has a sleeve (or sleeve portion) 110 and a use portion 185 attached thereto. The sleeve portion 110 may be comprised of, for example, at least a partially spandex material that enables the sleeve's stretchability. The sleeve provides a hygienic barrier to a tray table while also providing a use area on which a user can organize various personal or professional items. In some implementations, the body is comprised of a combination of polyester and spandex, but other stretchable materials are also possible. In contrast, the use portion 185 may be comprised of polyester or otherwise relatively tougher and have a more firm and rigid material compared to the sleeve, such as nylon. For example, the use portion 185 may be comprised of a 600D polyester with a hydrophobic coating. Other materials suitable for at least some of the purposes discussed herein are also possible, such as woven or nonwoven polyester, nylon, cotton, bamboo, rayon, or other fabric. The overall difference in material makeup is because of each component's function—the sleeve is to attach to a tray table, and the use portion is meant to provide various opportunities for the user to store, transport, and hold their belongings—both while the tray table cover 105 is in use or in transport.

The sleeve 110 includes an opening 405 (FIG. 4) at its bottom that is closable via base 190 and nylon strap 160— each configured with opposing and engageable hook-and-loop fasteners to seal the tray table cover 105 to a tray table, as described in further detail below. The base 190 is attached underneath the use portion 185 and in between the use portion and sleeve portion 190. In some implementations, the stitching that connects the use portion to the sleeve is continuously used to capture the base 190 as well. Alternatively, the base may have its own set of stitching that overlaps with the stitching that connects the use portion to the sleeve. Furthermore, at least a portion of the base extends past the stitching. Thus, the portion of the base shown in the drawings can be anywhere from 25 to 100 percent larger but is unshown as it is tucked behind and between the use portion 185 and sleeve 110.

The use portion 185 of the tray table cover 105 includes a series of zippered pouches: lower pouch 120, mid-pouch 125, and upper pouch 130. While zipper fasteners are shown for each pouch, other types of closure mechanisms are also possible, such as snaps, buttons, drawstring, etc. Pouches may also lack closure mechanisms. Each pouch is separated by a layer of material, such as nylon or other material so that materials placed in one pocket do not enter another. The lower pouch 120 includes an outer mesh material on its exterior to provide some transparency into the tray table cover's contents. The use area 185 of the tray table cover 105 also includes a pocket 135 having an opening 150 that, typically, may be used to hold drinking bottles, such as personal water bottles, Gatorade®, etc. For clarity in exposition, the pocket 135 may be described as a 'bottle pocket,' but it may be used for other purposes as well. While the terms pouches and pockets are used herein, they may generally be referred to as receptacles that can receive one or more items.

The pocket 135 has a drawstring 140 and a control mechanism 180 that enables the user to loosen or tighten the pocket based on the size of their drinking bottle. In the embodiment shown, the drawstring tightens the top part 145 of the pocket, but in other implementations, one or more drawstrings may be placed vertically throughout the pocket 135. For example, a single drawstring may pull multiple strings spread throughout the pocket or multiple individual drawings may be present throughout the pocket (e.g., from top to bottom) to enable a user greater customization and control. The bottle pocket's bottom may extend at or adjacent to an end of the use portion 185, and its upper end may substantially or at least partially align with the openings of the lower pouch 120 or the mid-pouch 125, or in between the two.

Between the bottle pocket 135 and the various pouches 120, 125, and 130 is a narrow or middle pocket 175 that may be used, for example, pens, pencils, styluses, and other writing utensils. The middle pocket—along with the other pouches and bottle pocket—has been crafted, configured, attached, and arranged to fully leverage the real estate afforded by the use portion 185 of the tray table cover. Since tray tables, such as those on trains and airplanes, are typically restricted in size to accommodate a single person, the tray table cover has been designed to leverage the available real estate to hold as many personal and professional items as possible while staying within an allotted zone of use. As discussed in greater detail below (FIG. 7), the middle pocket 175 was connected to the cover to firmly secure it in place while not irresponsibly using up available real estate.

Figure 8:
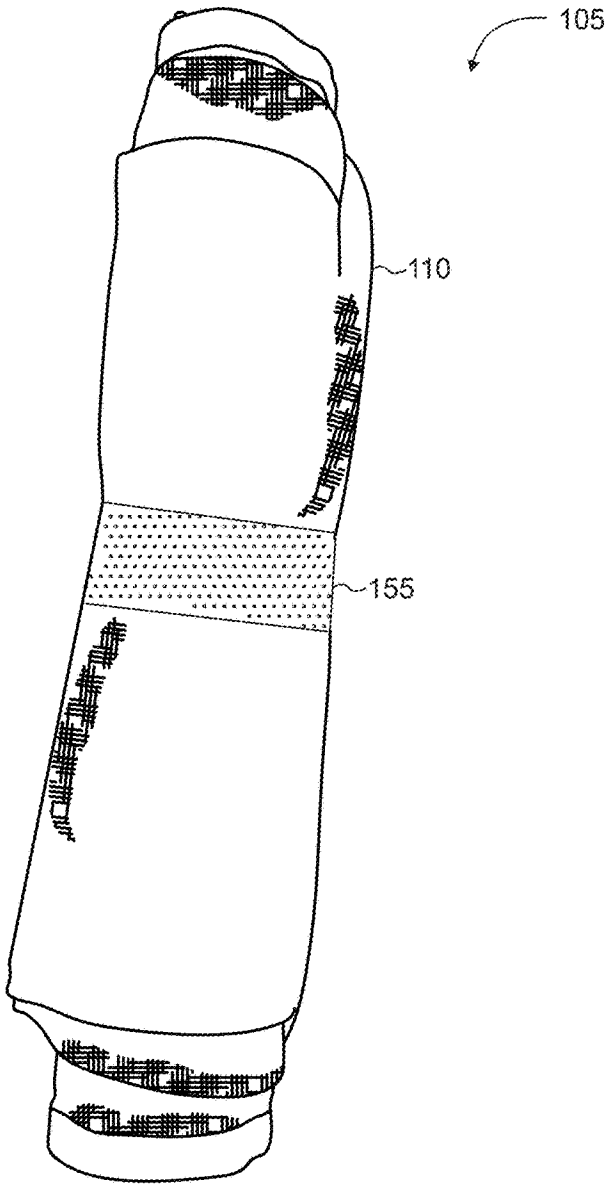
FIG. 8 shows an illustrative representation of the tray table cover fully rolled up and locked in place via a strap that extends around the entire cover.

The tray table cover's use area further includes closed loop hooks 170, on opposing sides of the cover, to which a carabiner 165, keychain, or other item can be attached. An elastic nylon strap 155 with hook and loop fasteners on opposing sides thereof is positioned on at least one side of the tray table cover 105 to enable a user to conveniently roll up and close the tray table for easy handling, storage, and transportation (FIG. 8). In typical implementations, the strap 155 may be attached at a central region of the cover's edge so as to wrap around the cover's center.

Figure 2:
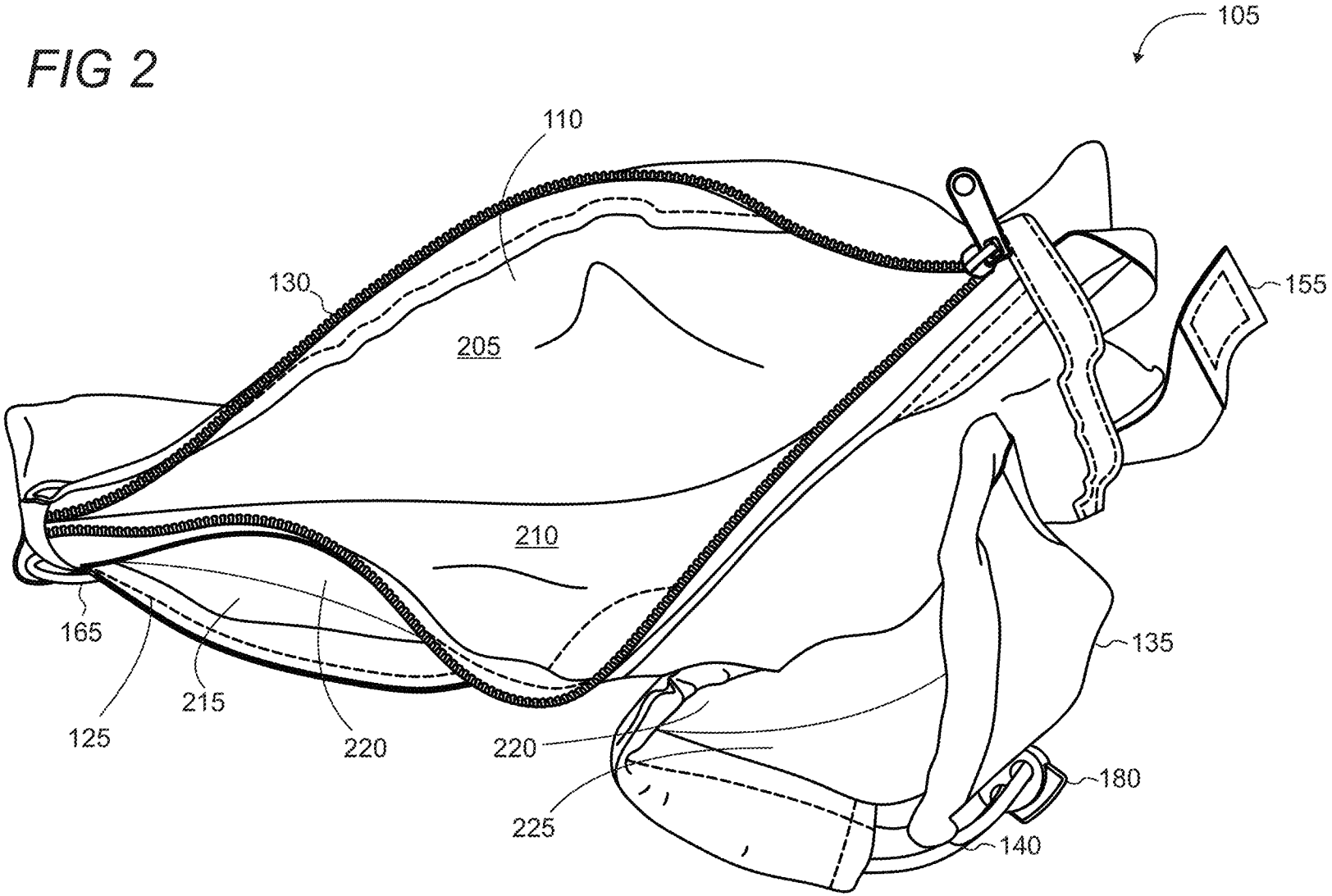
FIG. 2 shows an illustrative representation of the various pockets and openings on the top side of the tray table cover.

FIG. 2 shows an illustrative representation of the top side of the tray table cover 105, showing the mid-pouch's interiors 215 and 220, the top pouch's interiors 205 and 210, and the bottle pocket's interiors 220 and 225. The mid-pouch's and bottle pocket's rear interior sides are more rigid and similar to the material used for the use portion 185. For the upper pouch 130, mid-pouch 125, and bottle pocket 135, their front interior sides 210, 215, 225, respectively, have a more smoothened hard texture relative to their rear interior sides. Such customization of the material provides an enhanced user experience. For example, the rear interior sides may typically be engaged more than the front side of the pocket, so such a change in material helps prolong the tray table cover's shelf life. Regarding the top pouch 130, the rear interior side 205 is the interior of the sleeve 110, which is, therefore, the elastic spandex material. Since the sleeve portion 110 may typically be used to encapsulate a tray table, its interior layer was unchanged, at least with respect to its exterior portions.

Figure 3:
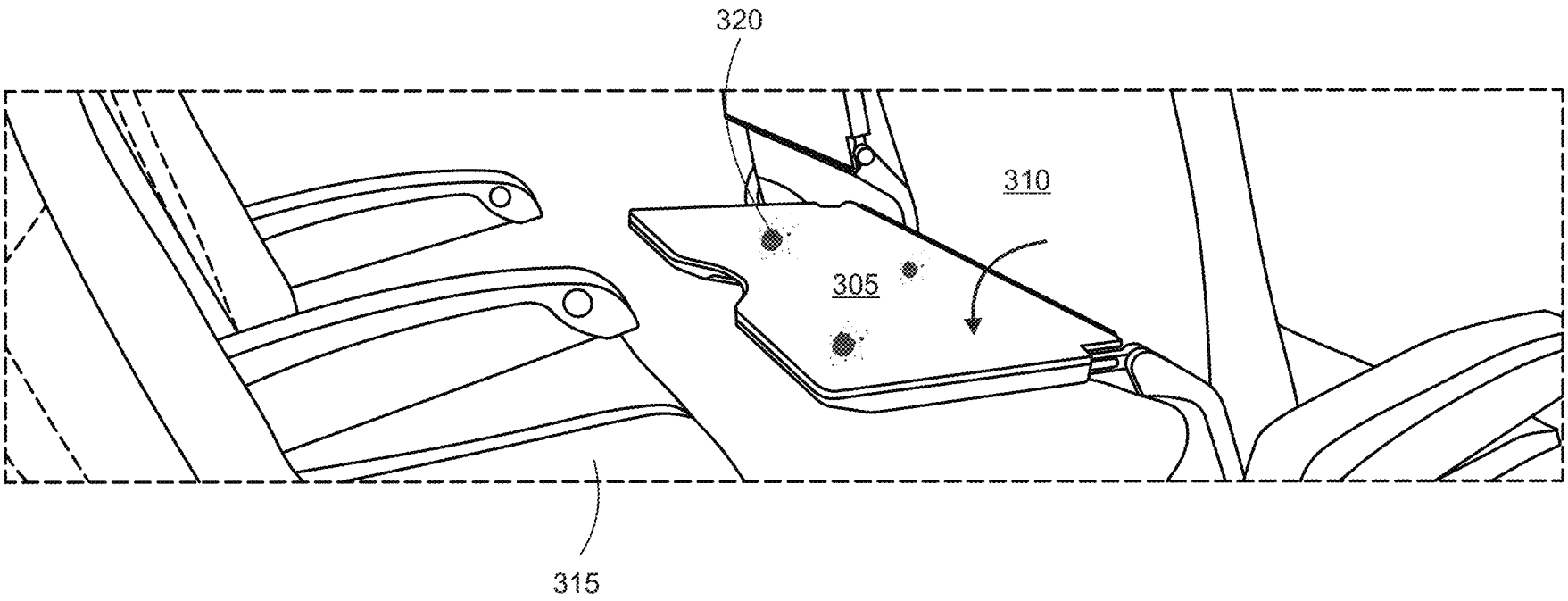
FIG. 3 shows an illustrative environment of an airplane's seating area with a tray table folded downward for use.

FIG. 3 shows an illustrative environment in which an airplane's setup includes a user's personal seat 315, tray table 305, and front seat 310 (i.e., the seat in front of the user's seat). The tray table has various germs and stains 320 on its surfaces, which is often a concern individuals have and, in general, feel uneasy about whenever traveling. While an airplane setup is shown and discussed herein, the tray table cover 105 discussed herein may work on any public or other table, such as on trains, buses, waiting areas, and other scenarios related to or unrelated to transportation.

Figure 4:
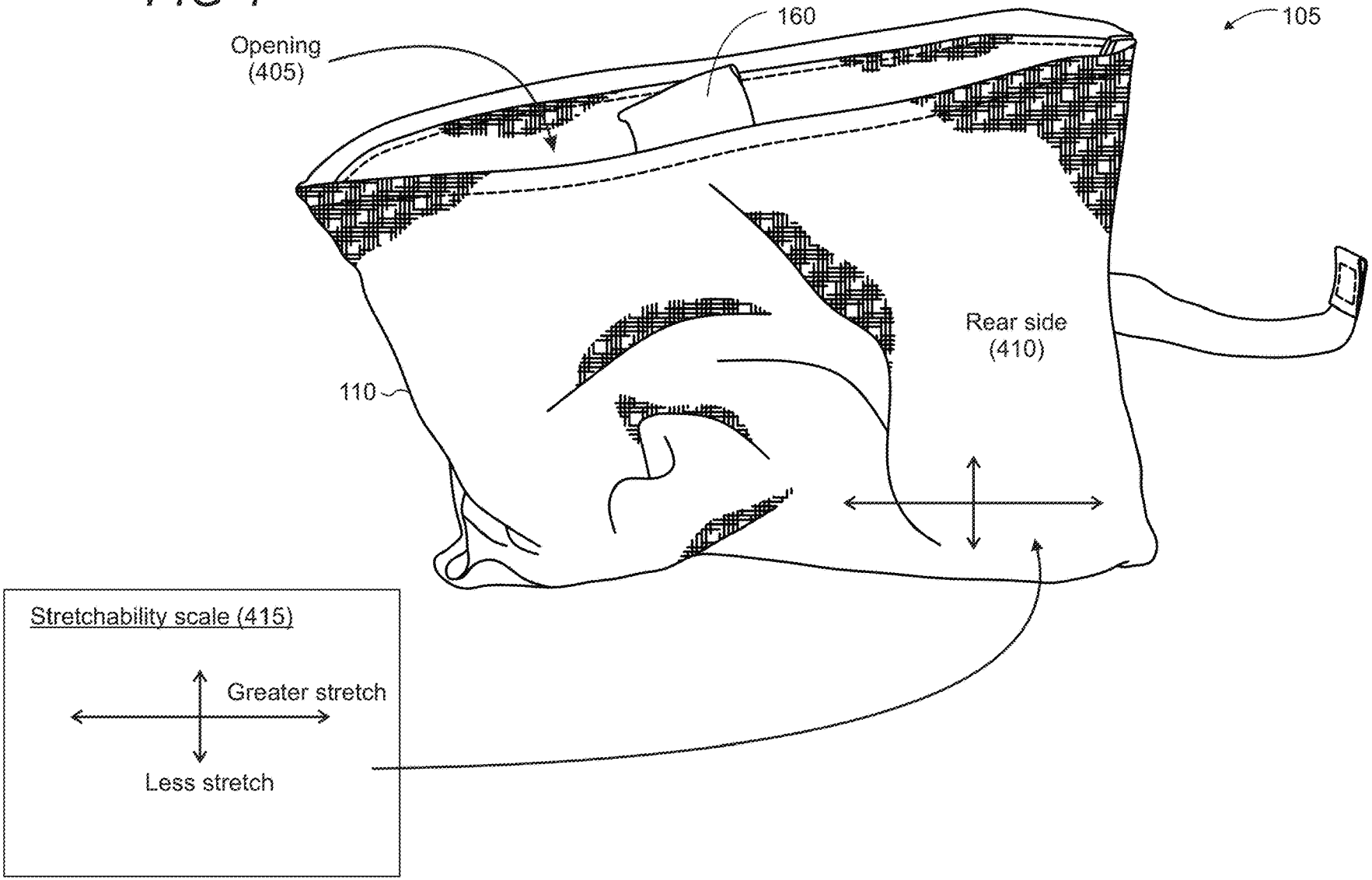
FIG. 4 shows an illustrative representation of the rear side of the tray table cover.

FIG. 4 shows an illustrative representation of an opening 405 on the sleeve portion 110 of the tray table cover 105. The opening 405 is opposite the access points to the upper, mid, and lower pouches 130, 125, and 120, respectively (FIG. 1). The opening is adapted to be shaped and sized to fit a range of tray tables 305 to accommodate various manufacturers, companies, etc. In typical implementations, the sleeve may be 14.25 inches wide and 10 inches deep, but other sizes smaller or larger than those are also possible, depending on the scenario. For example, tray tables are typically 14-17 inches wide, 8-10 inches deep, and 0.5-1 inch thick. The flexible fabric and overall size of the sleeve 110 accommodate at least these ranges of tray tables, but larger or smaller sleeves are also possible, depending on the implementation. For example, a similar configuration tray table cover 105 may be adapted to work on a student's desk at school or university. The top of the sleeve's opening may be hemmed to enhance the product's durability and appearance. Sewn into the sleeve hem is a closing nylon strap 160, with a hook and loop fastener on its surface, that engages with the base 190 on the opposite end of the sleeve (FIG. 1).

FIG. 4 further shows a stretchability scale 415 that illustrates the difference in stretchability within the fabric of the sleeve 110 in order to accommodate the use cases. As shown by the scale, the horizontal stretch of the sleeve is greater than the vertical stretch of the sleeve. In terms of magnitude, the horizontal stretch may be as great as 25-200% greater than the vertical stretch, but other implementations may be different. For example, the difference in directional stretch may be accomplished by the implemented weave pattern and configurations, such as more or less elastic fibers, orientation, etc.

Figure 5:
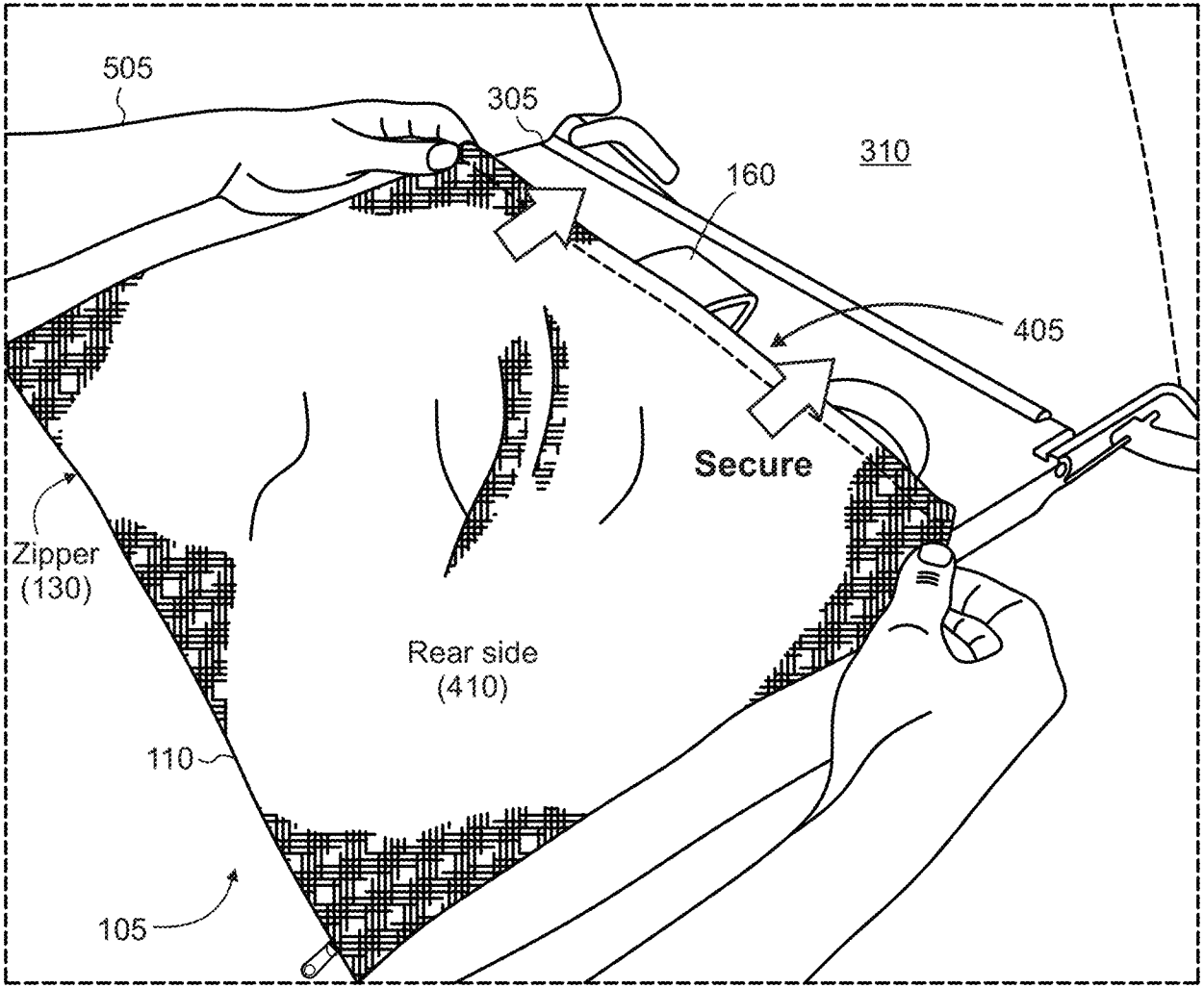
FIG. 5 shows an illustrative environment in which a user secures the tray table into the sleeve's tray table opening.

FIG. 5 shows an illustrative representation in which the sleeve 110 is secured to and at least partially encapsulates the tray table 405. The sleeve's opening 405 is maneuvered and propped around the tray table. The user 505 can manipulate the sleeve's elastic ability to fit around larger tray tables. Furthermore, the closure of the opening 405 using the closing strap 160 and base 190 can help tighten the sleeve onto the tray table, smaller or otherwise, thereby providing a snug fit. Furthermore, engaging the closing strap and base around the tray table may prevent the cover from being accidentally uninstalled from the tray table during use.

Figure 6:
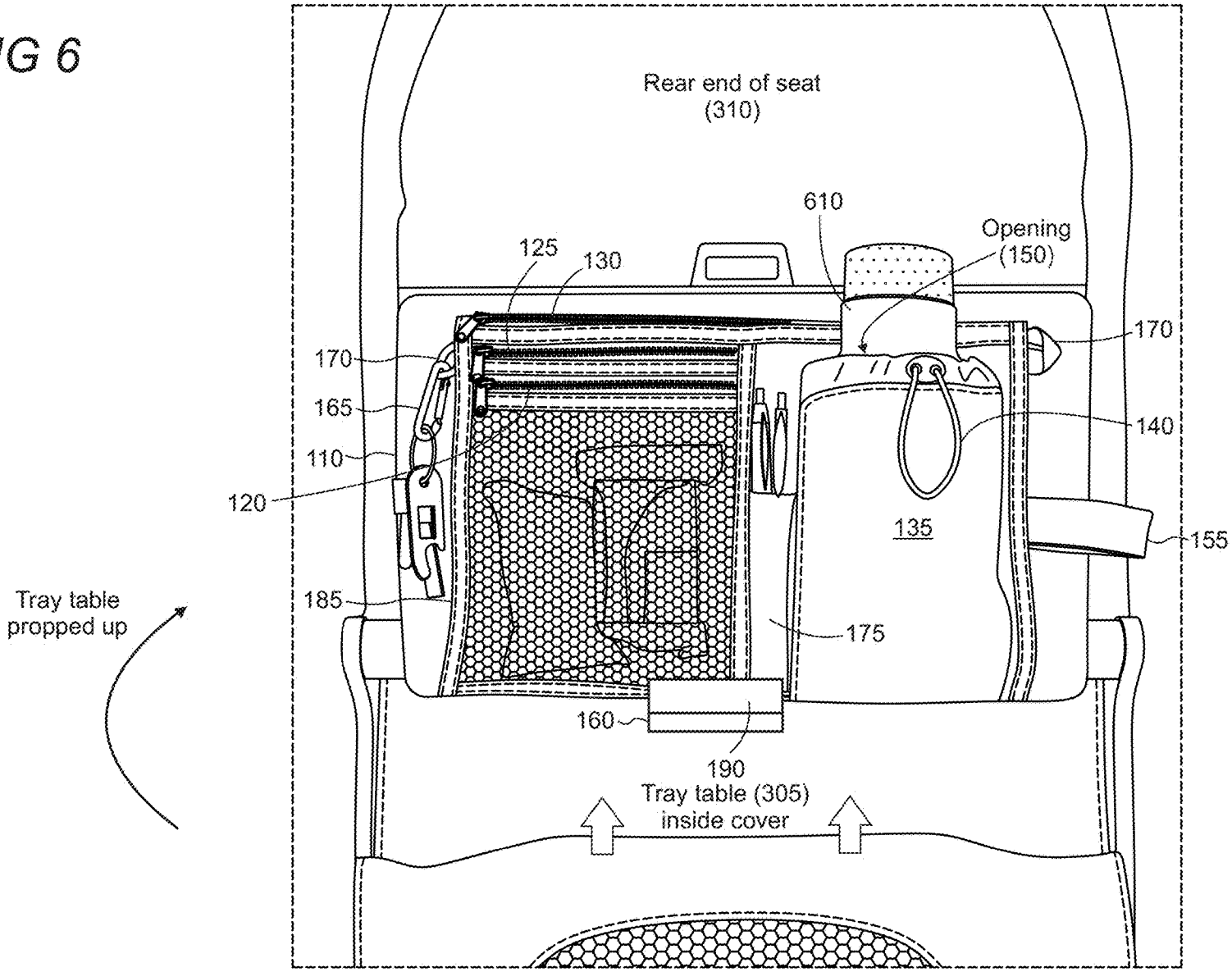
FIG. 6 shows an illustrative representation of the tray table in a closed position, thereby putting the tray cable cover in an upright and use position.

FIG. 6 shows an illustrative environment in which the sleeve 110 has been propped up against the front seat 310. Since the sleeve is secured to the tray table 305 via its base 190 and strap 160, it maintains its position with or without the use of the swivel lock. Thus, while the swivel lock may be behind the tray table cover 105, given the thinness of the sleeve's material, it may alternatively be placed over the sleeve. The sleeve's designs and configurations enable the sleeve to stay secured to the tray table even when in the closed position. Specifically, the relatively thin and malleable material allows the sleeve to fit between the closed tray table and the front seat 410 it is attached to.

As shown in FIG. 6, a water bottle 610 is placed inside the bottle pocket 135, and the drawstring 140 is tightened using the control mechanism 180 to secure the bottle in place. The user may, for example, pinch the control mechanism to loosen its grip from the string and enable the user to loosen or tighten the drawstring, and upon releasing the control mechanism, it clamps back down against the drawstring. The middle pocket 175 and lower pouch 120 are used to hold various writing utensils; the transparent nature of the mesh netting on the lower pouch enables the user to see through to its contents.

The lower and mid-pouches 120 and 125 are largely positioned on the left side of the use portion 185, whereas the bottle pocket 135 is positioned on the right side. For example, the left-hand pouches may extend 50-65% of the lateral length of the tray cover 105. The upper pouch 130, however, extends fully beyond the mid and lower pouches and the bottle pocket 135.

Figure 7:
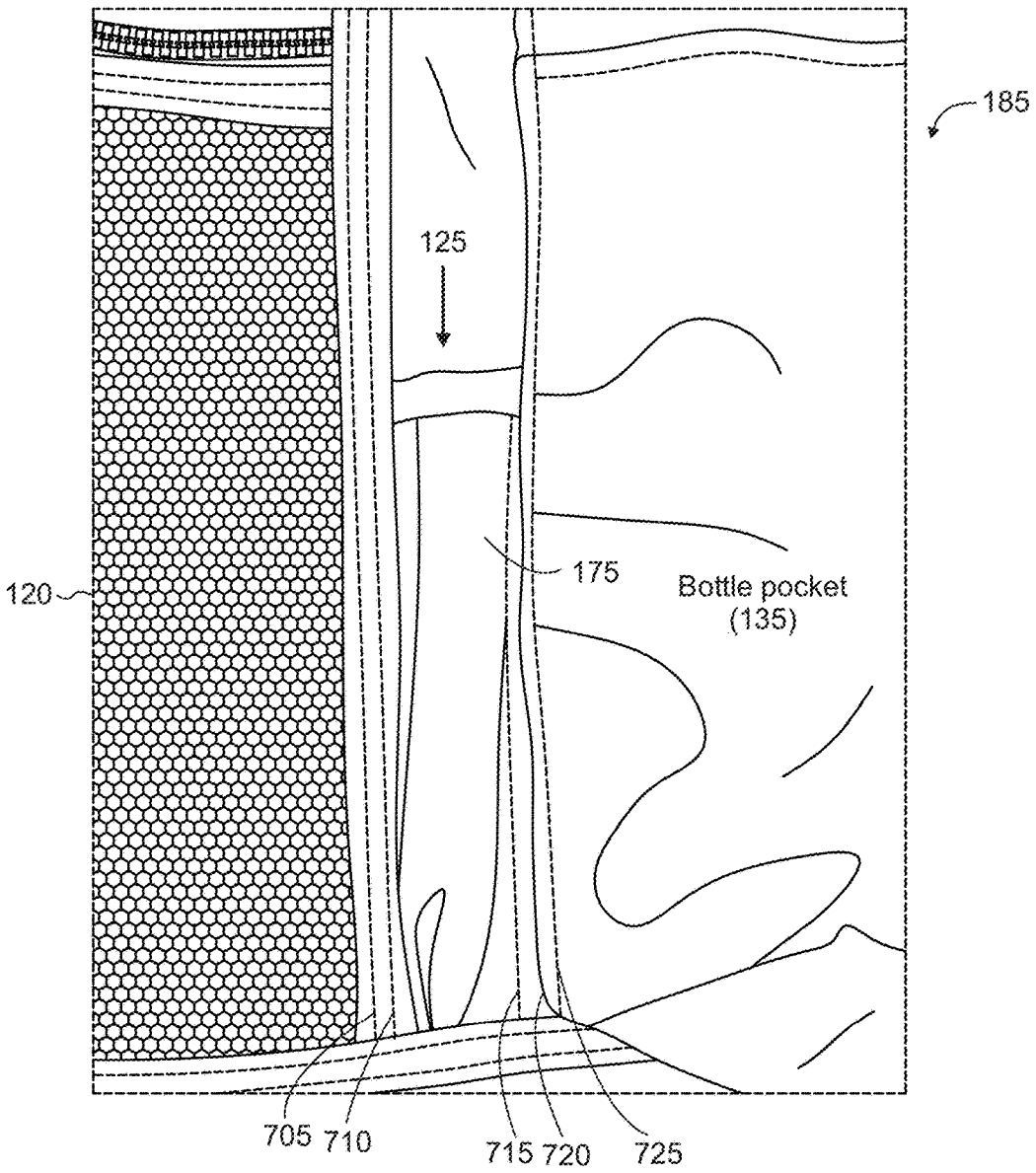
FIG. 7 shows an illustrative representation of the tray table cover's pocket configuration and attachment arrangement.

FIG. 7 shows an illustrative representation in which the middle pocket 175 is strategically secured between the bottle pocket 135 and the lower pouch 120 to leverage the available real estate while securely attaching the middle pocket to the use portion 185. On the left side of the middle pocket is stitching 705 and 710, which primarily attaches the lower pouch to the use area 185. The middle pocket, however, extends underneath the lower pouch's perimeter so that the stitching is dually utilized to secure two distinct receptacles. On the right side of the middle pocket 175 is a row of stitching 720 dedicated to the middle pocket to secure it against the use area 185. The end 720 of the middle pocket is shown on the right side, unlike the left side, and the other set of stitching 730 is for the bottle pocket 135. Thus, a space exists between the middle pocket's end 725 and the bottle pocket's adjacent end.

Furthermore, the stitching 710, 715, and 725 are observable from the upper pouch's front interior side 210 (FIG. 2). Stitching 705, however, is observable in the mid-pouch's front interior side 215 (FIG. 2). The specific configuration of the stitching and its placement is one factor that helps create a sturdy product that fits within a defined length influenced by tray tables created by third parties, such as airlines.

FIG. 8 shows an illustrative representation in which the tray table cover 105 has been rolled up into a cylindrical shape for easy storage. The user can wrap the strap 155 around the rolled-up cover, then attach the corresponding hook and loop fasteners. The fastener on an end of the strap engages with the corresponding fastener on the opposite side. In such a conveniently compact state, the user could opt to use one of the loops 160 to hook the tray table cover 105 to their luggage, backpack, etc.

Various exemplary embodiments are shown and described herein. In one exemplary embodiment is a tray table cover, comprising: a sleeve having an opening adapted to at least partially encapsulate a tray table, a use portion comprised of a more rigid material relative to the sleeve, the use portion attached to the sleeve; a lower pouch positioned at least partially on one side of the tray table cover; and an upper pouch that extends from a left to a right side of the tray table cover.

A another example, the sleeve is comprised of a spandex material and is configured to have greater stretchability in a lateral direction relative to a vertical direction. In a further example, a bottle pocket positioned at least partially on an opposite side of the tray table cover relative to the lower pouch, the pocket extending from a bottom portion of the tray table cover and its upper end at least partially aligning with the lower pouch's opening. As another example, a middle pocket is positioned between the lower pouch and the bottle pocket. As a further example, at least one side of the middle pocket is secured in place with stitching that overlaps with and attaches the lower pouch to the use portion. In another example, on an opposite side of the middle pocket is a dedicated set of stitches that attaches the middle pocket to the use portion, such that there is a space in between the bottle pocket's end and the middle pocket's end. In a further example, a mid-pouch positioned between the lower pouch and the upper pouch. As another example, a base fastener attached at least partially adjacent to the lower pouch and at or adjacent to a bottom surface of the tray table cover, and wherein a portion of the base fastener is secured to the tray table cover with stitching that is also used to secure the lower pouch to the use portion. In another example, a rear interior surface of the upper pouch is a same material as the sleeve.

In another exemplary embodiment, disclosed is a method of securing a tray table cover to a tray table, comprising: providing a sleeve having an opening adapted to at least partially encapsulate a tray table, attaching a use portion comprised of a more rigid material relative to the sleeve; positioning a lower pouch at least partially on one side of the tray table cover; and positioning an upper pouch extending from a left to a right side of the tray table cover.

As another example, the sleeve is comprised of a spandex material and is configured to have greater stretchability in a lateral direction relative to a vertical direction. In a further example, a bottle pocket positioned at least partially on an opposite side of the tray table cover relative to the lower pouch, the pocket extending from a bottom portion of the tray table cover and its upper end at least partially aligning with the lower pouch's opening. As another example, a middle pocket is positioned between the lower pouch and the bottle pocket. In another example, at least one side of the middle pocket is secured in place with stitching that overlaps with and attaches the lower pouch to the use portion. As another example, on an opposite side of the middle pocket is a dedicated set of stitches that attaches the middle pocket to the use portion, such that there is a space in between the bottle pocket's end and the middle pocket's end. In a further example, positioning a mid-pouch between the lower pouch and the upper pouch. As another example, a base fastener attached at least partially adjacent to the lower pouch and at or adjacent to a bottom surface of the tray table cover, and wherein a portion of the base fastener is secured to the tray table cover with stitching that is also used to secure the lower pouch to the use portion. In another example, a rear interior surface of the upper pouch is a same material as the sleeve.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed:

1. A tray table cover, comprising:

a sleeve having an opening adapted to at least partially encapsulate a tray table, the sleeve having an outward exposing sleeve side, wherein the sleeve has a single opening at its bottom to enable positioning the sleeve over the tray table;

a fastener positioned adjacent to the sleeve's opening to better secure the sleeve to the tray table;

a use portion comprised of a more rigid material relative to the sleeve, the use portion attached to the sleeve, wherein the sleeve and the use portion are attached to each other at their respective back sides, and the use portion has a use portion side that is outward exposing, and wherein, due to the use portion and sleeve being attached to each other, any movement of the tray table while the sleeve is secured to the tray table causes corresponding movements;

a lower pouch positioned at least partially on the use portion side of the use portion; and an upper pouch that extends from a left to a right side of the use portion side, in which, when the tray table cover is secured to the tray table, the sleeve side is substantially positioned on one side of the tray table, and the use portion side is substantially positioned on an opposite side of the tray table, wherein, when the tray table is in a vertically closed position, the upper pouch and lower pouch are accessible and in an upright position that is parallel to the tray table, and when the tray table is in a horizontally used position, the sleeve side is accessible.

2. The tray table cover of claim 1, wherein the sleeve is comprised of a spandex material and is configured to have greater stretchability in a lateral direction relative to a vertical direction.

3. The tray table cover of claim 1, further comprising a bottle pocket positioned at least partially on the use portion side, the bottle pocket extending from a bottom portion of the use portion side and its upper end at least partially aligning with the lower pouch's opening.

4. The tray table cover of claim 3, wherein a middle pocket is positioned between the lower pouch and the bottle pocket.

5. The tray table cover of claim 4, wherein at least one side of the middle pocket is secured in place with stitching that overlaps with and attaches the lower pouch to the use portion.

6. The tray table cover of claim 5, wherein on a rear side of the middle pocket is a dedicated set of stitches that attaches the middle pocket to the use portion, such that there is a space in between the bottle pocket's end and the middle pocket's end.

7. The tray table cover of claim 1, further comprising a mid-pouch positioned between the lower pouch and the upper pouch.

8. The tray table cover of claim 1, further comprising a base fastener attached at least partially adjacent to the lower pouch and at or adjacent to a bottom surface of the tray table cover, and wherein a portion of the base fastener is secured to the tray table cover with stitching that is also used to secure the lower pouch to the use portion.

9. The tray table cover of claim 1, wherein a rear interior surface of the upper pouch is a same material as the sleeve.

10. A method of securing a tray table cover to a tray table, comprising:

providing a sleeve having an opening adapted to at least partially encapsulate a tray table, the sleeve having an outward exposing sleeve side, wherein the sleeve has a single opening at its bottom to enable positioning the sleeve over the tray table;

engaging a fastener that is positioned adjacent to the sleeve's opening to secure the sleeve to the tray table;

attaching a use portion comprised of a more rigid material relative to the sleeve, wherein the sleeve and the use portion are attached to each other at their respective back sides, and the use portion has a use portion side that is outward exposing, and wherein, due to the use portion and sleeve being attached to each other, any movement of the tray table while the sleeve is secured to the tray table causes corresponding movements;

positioning a lower pouch at least partially on the use portion side of the use portion; and positioning an upper pouch extending from a left to a right side of the use portion side, in which, when the tray table cover is secured to the tray table, the sleeve side is substantially positioned on one side of the tray table, and the use portion side is substantially positioned on an opposite side of the tray table, wherein, when the tray table is in a vertically closed position, the upper pouch and lower pouch are accessible and in an upright position that is parallel to the tray table, and when the tray table is in a horizontally used position, the sleeve side is accessible.

11. The method of claim 10, wherein the sleeve is comprised of a spandex material and is configured to have greater stretchability in a lateral direction relative to a vertical direction.

12. The method of claim 10, further comprising a bottle pocket positioned at least partially on use portion side, the bottle pocket extending from a bottom portion of the use portion side and its upper end at least partially aligning with the lower pouch's opening.

13. The method of claim 12, wherein a middle pocket is positioned between the lower pouch and the bottle pocket.

14. The method of claim 13, wherein at least one side of the middle pocket is secured in place with stitching that overlaps with and attaches the lower pouch to the use portion.

15. The method of claim 14, wherein on a rear side of the middle pocket is a dedicated set of stitches that attaches the middle pocket to the use portion, such that there is a space in between the bottle pocket's end and the middle pocket's end.

16. The method of claim 10, further comprising positioning a mid-pouch between the lower pouch and the upper pouch.

17. The method of claim 10, further comprising a base fastener attached at least partially adjacent to the lower pouch and at or adjacent to a bottom surface of the tray table cover, and wherein a portion of the base fastener is secured to the tray table cover with stitching that is also used to secure the lower pouch to the use portion.

18. The method of claim 10, wherein a rear interior surface of the upper pouch is a same material as the sleeve.

* * * * *